US005557245A

United States Patent [19]

Taketa et al.

[11] Patent Number: 5,557,245

[45] Date of Patent: Sep. 17, 1996

[54] STRIP LINE-TYPE HIGH-FREQUENCY ELEMENT

[75] Inventors: Tsuyoshi Taketa; Toru Ishida; Yasushi Kishimoto, all of Tottori, Japan

[73] Assignee: Hitachi Metals, Ltd., Tokyo, Japan

[21] Appl. No.: 298,341

[22] Filed: Aug. 30, 1994

[30] Foreign Application Priority Data

Aug. 31, 1993 [JP] Japan ..... 5-240468
Aug. 22, 1994 [JP] Japan ..... 6-221126

[51] Int. Cl.[6] ..... H01P 5/18

[52] U.S. Cl. ..... 333/116; 333/246

[58] Field of Search ..... 333/116, 112, 333/118, 117, 185, 246; 336/206

[56] References Cited

U.S. PATENT DOCUMENTS

| | | | |
|---|---|---|---|
| B 535,256 | 3/1976 | Caragliano et al. | 333/112 |
| 3,164,790 | 1/1965 | Oh | 333/116 |
| 5,349,743 | 9/1994 | Grader et al. | 29/602.1 |
| 5,369,379 | 11/1994 | Fujiki | 333/116 |
| 5,382,925 | 1/1995 | Hayashi et al. | 333/112 |

FOREIGN PATENT DOCUMENTS

| | | |
|---|---|---|
| 95372 | 9/1979 | France . |
| 2525776 | 10/1983 | France . |
| 4241148 | 6/1993 | Germany . |
| 5152814 | 6/1993 | Japan . |
| 5160614 | 6/1993 | Japan . |

OTHER PUBLICATIONS

IBM Technical Disclosure Bulletin, vol. 8, No. 5 (Oct. 1965).

*Primary Examiner*—Benny Lee
*Attorney, Agent, or Firm*—Sughrue, Mion, Zinn, Macpeak & Seas

[57] ABSTRACT

A strip line-type high-frequency element constituted by a laminate including a first ground conductor electrode substrate 2; a substrate 3 having a first strip line electrode 3*a* of less than one turn having a through-hole round electrode 3*e;* a substrate 4 having a second strip line electrode 4*a* of one or more turns having a through-hole electrode 4*f;* a substrate 5 having a third strip line electrode 5*a* of one or more turns having a through-hole round electrode 5*e;* a substrate 6 having a fourth strip line electrode 6*a* of less than one turn having a through-hole electrode 6*f;* a second ground conductor electrode substrate 7; and a protective substrate 8, wherein the through-hole round electrode 3*e* of the first strip line electrode 3*a* is connected to the through-hole electrode 4*f* of the second strip line 4*a* to form a first line, and the through-hole round electrode 5*e* of the third strip line electrode 5*a* is connected to the through-hole electrode 6*f* of the fourth strip line 6*a* to form a second line, one of the first and second lines being a main line while the other being a sub-line, whereby the strip line-type high-frequency element functions as a directional coupler.

6 Claims, 5 Drawing Sheets

STRIP LINE-TYPE HIGH-FREQUENCY ELEMENT

BACKGROUND OF THE INVENTION

The present invention relates to a high-frequency element comprising a plurality of strip lines, more particularly to a chip-type directional coupler.

Conventional high-frequency elements comprising a plurality of strip lines are illustrated as a directional coupler in FIG. 4. In this directional coupler, a main line and a sub-line are disposed on the same substrate as a planar type. Two strip lines 53, 54 are disposed in parallel at an interval S on a front surface of a dielectric substrate 51 formed with a ground conductor 52 on a rear surface. Each of the parallel portions of the strip lines 53, 54 is as long as one-fourth a wave length of an electromagnetic wave propagating through the dielectric substrate 51.

A high-frequency signal supplied from a port $P_1$ passes through a strip line 53 (main line) and exits from a port $P_2$. At this time, by coupling of the strip line 53 (main line) and the strip line 54 (sub-line), part of electric power of the high-frequency signal passing through the strip line 53 flows into the strip line 54 and goes to the port $P_3$. As a result, there is no output at port $P_4$. Next, when a high-frequency signal flows through the strip line 53 (main line) in an opposite direction, namely from a port $P_2$ to a port $P_1$, part of electric power of the high-frequency signal goes to a port $P_4$, not to a port $P_3$. Thus, with this structure, part of an electric signal passing through the strip lines 53 (main line) in a forward direction and part of the signal passing in an opposite direction can be led to the output ports $P_3$ and $P_4$, respectively, of the strip line 54 (sub-line). This is the basic operation of the directional coupler.

The coupling of the main line 53 to the sub-line 54 can be controlled by adjusting a distance S between the parallel portions of the two strip lines.

In FIG. 4, illustrating the conventional directional coupler, the main line is a strip line 53 while the sub-line is a strip line 54. However, because of the structural symmetricity, the main line and the sub-line may be interchangeable without affecting the basic operation of the directional coupler.

FIG. 5 shows another conventional directional coupler in which a strip line 65 (main line) and a strip line 66 (sub-line) are stacked. In this example, a strip line 66 is formed on a front surface of a dielectric substrate 61 coated with a ground conductor 64 on a rear surface. Disposed above the substrate 61 is a dielectric substrate 62 formed with a strip line. 65 (main line) such that the strip line 65 (main line) is separated from the strip line 66 (subline) by a distance D. Disposed thereon is a protective dielectric substrate 63.

These three substrates are laminated and sintered, and external electrodes $P_1$, $P_2$, $P_3$, $P_4$ are attached thereto to complete a directional coupler, which is perspectively shown in FIG. 6.

The directional coupler of FIG. 6 may be operated in the same manner as in FIG. 4. A high-frequency signal supplied from a port $P_1$ passes through a strip line 65 (main line) and exits from a port $P_2$. At this time, by coupling of the strip line 65 (main line) and the strip line 66 (sub-line), part of electric power of the signal passing through the strip line 65 flows into the strip line 66 and goes to the port $P_3$. As a result, there is no output at port $P_4$. Next, when an electric signal flows through strip line 65 (main line) in an opposite direction, namely from a port $P_2$ to a port $P_1$, part of electric power of the signal goes to a port $P_4$, not to a port $P_3$. Thus, with this structure, part of electric power of the signal passing through the strip line 65 (main line) in a forward direction and that in an opposite direction can be separated and led to the output ports $P_3$ and $P_4$, respectively, of the strip line 66 (sub-line).

The coupling of the main line 65 to the sub-line 66 can be controlled by adjusting a distance in a laminating direction between parallel portions of the two strip lines, namely a thickness D of a dielectric substrate 62.

Such a directional coupler having a function to separate high-frequency signals depending on its direction may be used for controlling output power of microwave signals, for instance, in transmitters of portable telephones. FIG. 7 is a block diagram showing one example of circuits comprising such directional couplers. A directional coupler 71 comprises a main line 72 having ports $P_1$, $P_2$ disposed between a transmitted signal-amplifying means (simply amplifier) 101 and an antenna 74; and a sub-line 73 having a port $P_3$ connected to an automatic gain-controlling circuit 102 and another port $P_4$ connected to a grounded resistor electrode 75 for absorbing electric power. With such a circuit, part of the output from the amplifier 101 connected to a modulator 103 goes to a port $P_3$ only, and returns to the automatic gain-controlling circuit 102. Part of the high-frequency signal returning from the antenna 74 goes to a port $P_4$ and is absorbed by the grounded resistor electrode 75. The output signal from the automatic gain-controlling circuit 102 is supplied to the amplifier 101 having a controllable gain to control high-frequency output in order to maintain the suitable transmission for various circumstances.

However, it is important to miniaturize portable telephones, and the directional couplers used in such portable telephones for the above-mentioned purposes are also required to be made small. In the conventional directional couplers of one-fourth wave length as illustrated in FIG. 4, the strip line electrode should be as long as 2.5 cm (corresponding to ¼ wave length at a relative dielectric constant $\epsilon_r$ of about 9) at 1 GHz, making it difficult to sufficiently miniaturize the directional couplers. Further, it may be conceivable to use a material having a larger relative dielectric constant in order to shorten one-fourth the wave length, but the strip line should have an extremely small width to keep an impedance of 50 Ω, and the strip line should be arranged at an extremely small distance to obtain a desired coupling of the main line and the sub-line. In order to realize these components, high working precision is required, making it difficult to mass-produce the directional couplers, and also lowering the power capabilities of the directional couplers.

Also, in a structure in which a plurality of strip lines are laminated vertically as shown in FIG. 5, control range may be widened since two strip lines are coupled in a plane. However, as far as miniaturization is concerned, this structure does not work. As a measure for miniaturization, it may be possible to shorten the strip line less than one-fourth the wave length. The characteristics of a directional coupler tentatively manufactured along this idea (shown in FIG. 5) are shown by dotted lines in FIGS. 3A and 3B. Here, a propagation loss from a port $P_1$ to a port $P_2$ is called "insertion loss (see FIG. 3A)," a propagation loss from a port $P_1$ to a port $P_3$ is called "coupling loss (see FIG. 3B)," and a propagation loss from a port $P_1$ to a port $P_4$ is called "isolation." With respect to the directional coupler, the insertion loss should be as small as possible, while the isolation should be as large as possible. The coupling loss is a parameter given by an overall circuit design in a portable telephone, etc.

As is shown by the dotted lines in FIGS. 3A and 3B, when the strip lines are merely made longer in the conventional directional coupler, high isolation cannot sufficiently be achieved in a wide frequency range.

OBJECT AND SUMMARY OF THE INVENTION

Accordingly, an object of the present invention is to provide a miniaturized strip line-type high-frequency element such as a chip-type directional coupler.

In an aspect of the present invention, there is provided a strip line-type high-frequency element comprising a plurality of wide ground conductors, and first and second strip lines disposed in an area covered by the ground conductors, wherein the first and second strip lines are connected to form a coil of one or more turns, and wherein the strip lines are disposed opposite each other such that they look aligned when viewed in a direction perpendicular to their winding direction.

In a preferred embodiment, the first and second strip lines are constituted by conductors formed on two or more dielectric substrates or magnetic substrates.

In another preferred embodiment, each of the first and second strip lines is as long as 1/8 to 1/15 a wave length, whereby the strip line-type high-frequency element functions as a directional coupler.

Thus, in a specific embodiment, the strip line-type high-frequency element according to the present invention is constituted by a laminate comprising successively from bottom:

a substrate formed with a first ground conductor electrode having lead portions extending to side edges;

a substrate formed with a first strip line electrode of less than one turn having a lead portion extending to a side edge of the substrate at one end and a through-hole round electrode at the other end;

a substrate formed with a second strip line electrode of less than one turn having a lead portion extending to a side edge of the substrate at one end and a through-hole electrode at the other end;

a substrate formed with a third strip line electrode of less than one turn having a lead portion extending to a side edge of the substrate at one end and a through-hole round electrode at the other end;

a substrate formed with a fourth strip line electrode of less than one turn having a lead portion extending to a side edge of the substrate at one end and a through-hole electrode at the other end;

a substrate formed with a second ground conductor electrode having lead portions extending to side edges; and a protective substrate, wherein the through-hole round electrode of the first strip line electrode is connected to the through-hole electrode of the second strip line to form a first line, and the through-hole round electrode of the third strip line electrode is connected to the through-hole electrode of the fourth strip line to form a second line, one of the first and second lines being a main line while the other being a sub-line, whereby the strip line-type high-frequency element functions as a directional coupler.

Further, the strip line-type high-frequency element according to another specific embodiment of the present invention is constituted by a laminate comprising successively from bottom:

a substrate formed with a first ground conductor electrode having lead portions extending to side edges;

a substrate formed with a first strip line electrode of less than one turn having a lead portion extending to a side edge of the substrate at one end and a through-hole round electrode at the other end;

a substrate formed with a second strip line electrode of one or more turns having a lead portion extending to a side edge of the substrate at one end and a through-hole electrode at the other end;

a substrate formed with a third strip line electrode of one or more turns having a lead portion extending to a side edge of the substrate at one end and a through-hole round electrode at the other end;

a substrate formed with a fourth strip line electrode of less than one turn having a lead portion extending to a side edge of the substrate at one end and a through-hole electrode at the other end;

a substrate formed with a second ground conductor electrode having lead portions extending to side edges; and a protective substrate, wherein the through-hole round electrode of the first strip line electrode is connected to the through-hole electrode of the second strip line to form a first line, and the through-hole round electrode of the third strip line electrode is connected to the through-hole electrode of the fourth strip line to form a second line, one of the first and second lines being a main line while the other being a sub-line, whereby the strip line-type high-frequency element functions as a directional coupler.

DETAILED DESCRIPTION OF THE PREFERRED EMBODIMENTS

Figure 1:
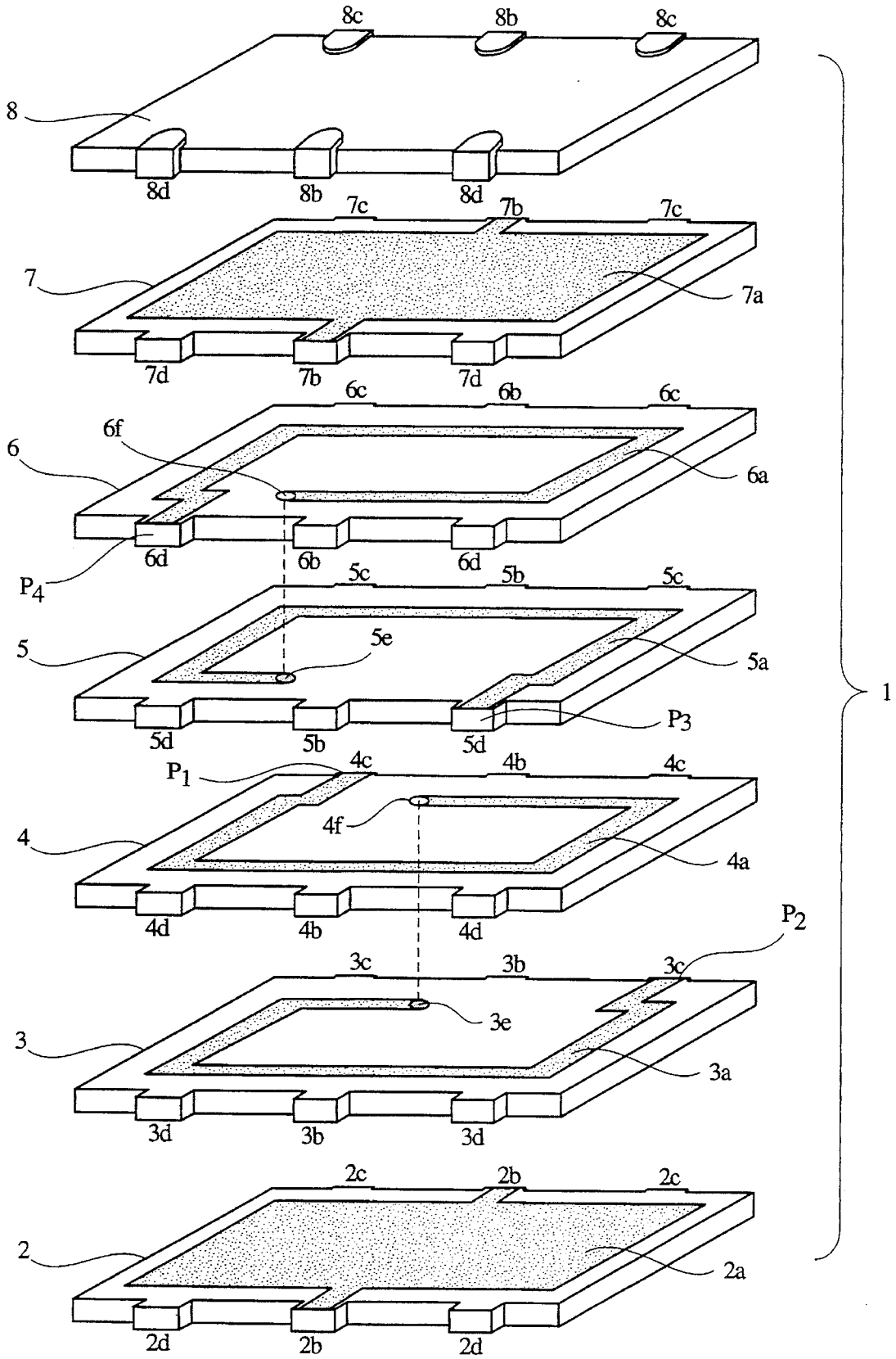
FIG. 1 is an exploded perspective view showing a strip line-type high-frequency element according to one embodiment of the present invention.
Figure 2:
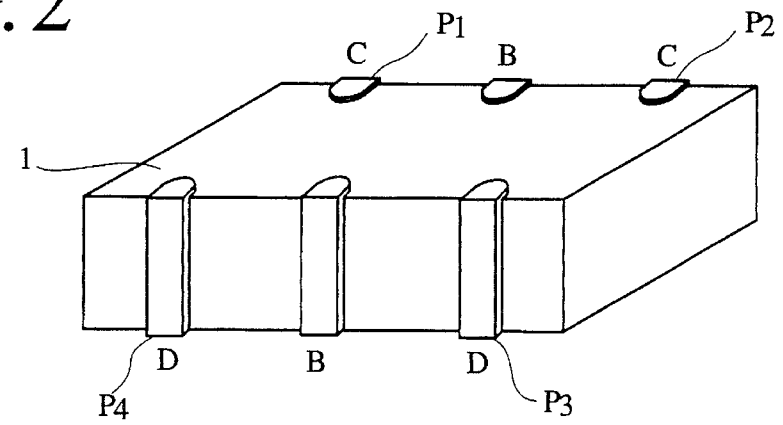
FIG. 2 is a perspective view showing a strip line-type high-frequency element according to one embodiment of the present invention.

FIG. 1 shows in an exploded manner a strip line-type high-frequency element such as a chip-type directional coupler 1 according to one embodiment of the present invention, and FIG. 2 shows the same chip-type directional coupler 1 of the present invention in an assembled state.

The chip-type directional coupler 1 according to one embodiment of the present invention is formed by laminating a substrate 2 provided with a first ground conductor electrode 2*a*, substrates 3, 4 provided with strip lines 3*a*, 4*a*, respectively for a main line, substrates 5, 6 provided with sub-lines 5*a*, 6*a*, respectively for a sub-line, a substrate 7 provided with a second ground conductor electrode 7*a*, and a protective substrate 8. Each substrate may be made of a ceramic green sheet sinterable at a low temperature.

The first ground conductor electrode 2*a* on the substrate 2 is provided with two projections at center points in side edges, and the two projections are connected to two external electrodes 2*b*. The substrate 2 is provided with separate external electrodes 2*c*, 2*d* at side edges, which are connected to the main strip line and the sub-strip line.

The substrate 3 for a main line is obtained by forming a strip line electrode 3*a* and a through-hole round electrode 3*e* on one surface of a ceramic green sheet. One end of the strip line electrode 3*a* is connected to an external electrode 3*c*. The substrate 3 is provided with external electrodes 3*b*, 3*c* and 3*d* at side edges.

Another substrate for a main strip line is denoted by a reference numeral 4 in FIG. 1. This substrate 4 is prepared by forming a strip line electrode 4*a* and a through-hole 4*f* on one surface of a ceramic green sheet. One end of the strip line electrode 4*a* is connected to an external electrode 4*c*, and the other end of the strip line electrode 4*a*, which is a through-hole 4*f*, is connected to a through-hole round electrode 3*e* on the strip line substrate 3. The connected strip line electrodes 3*a*, 4*a* form a coil having two turns. The substrate 4 is provided with external electrodes 4*b*, 4*c* and 4*d* at side edges.

The substrates 5, 6 for sub-strip line electrodes have the same structures as those of the substrates 3, 4 for the main strip line electrodes. The strip line electrodes 5*a*, 6*a* are connected to a through-hole 6*f* and a round electrode 5*e*, respectively to form a two-turn coil. The ends of the strip line electrodes 5*a*, 6*a* are connected to external electrodes 5*d*, 6*d* at side edges. The substrates 5, 6 are respectively provided with separate external electrodes 5*b*, 5*c*, 5*d*, 6*b*, 6*c* and 6*d* at side edges thereof.

The second ground conductor electrode substrate 7 has the same structure as that of the first ground conductor electrode substrate 2, and may be prepared by forming a ground conductor electrode 7*a* on one surface of a ceramic green sheet with its edge portions uncovered.

The first ground conductor electrode 2*a* is connected to the second ground conductor electrode 7*a* via external electrodes 2*b*, 3*b*, 4*b*, 5*b*, 6*b* and 7*b*, covering the strip line electrodes 3*a*, 4*a*, 5*a* and 6*a*, respectively. With this structure, a shield effect of preventing a high-frequency signal from leaking outside can be obtained.

The protective substrate 8 is provided with separate external electrodes 8*b*, 8*c*, 8*d* at an upper surface and side edges.

The green sheets 2–8 are printed with electrode layers, laminated, and then sintered at a temperature of 900° C. or higher to form an integral chip-type directional coupler 1 as shown in FIG. 2. The external electrodes designated by b, c, d of each green sheet at side edges are made integral by sintering to form external electrodes B, C, D as shown in FIG. 2. Incidentally, external electrodes designated by b, c, d are formed in the green sheet at side edges in this embodiment, but a high-frequency element having the same structure can be obtained by forming external electrodes B, C, D after sintering the laminate of the green sheets.

The ceramic green sheet in this embodiment has a thickness of 0.15 mm and is made of a dielectric material having a relative dielectric constant $\epsilon_r$ of about 8 and capable of being sintered at 900° C. Each strip line electrode is a copper electrode having a thickness of 15 μm and a width of 0.16 mm. An outer dimension of the chip-type directional coupler 1 produced by lamination and integral sintering is typically 3.2 mm long, 1.6 mm wide, and 1.2 mm thick.

In the embodiment shown in FIGS. 1 and 2, the external electrode B is connected to the ground conductor, the external electrode C to the main line, and the external electrode D to the sub-line.

Figure 3A:
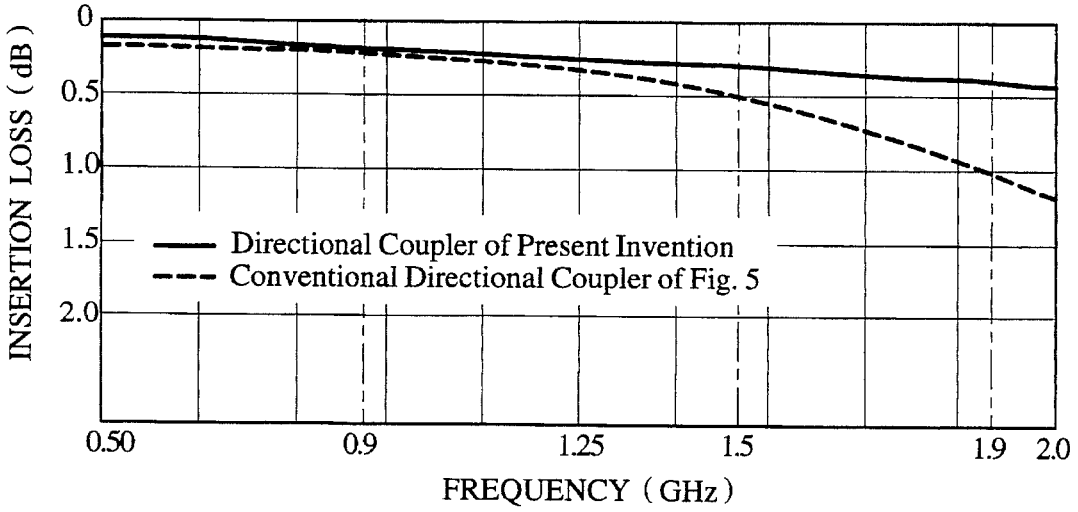
FIG. 3A is a graph showing the insertion loss of the strip line-type high-frequency element of the present invention and a conventional strip line-type high-frequency element.
Figure 3B:
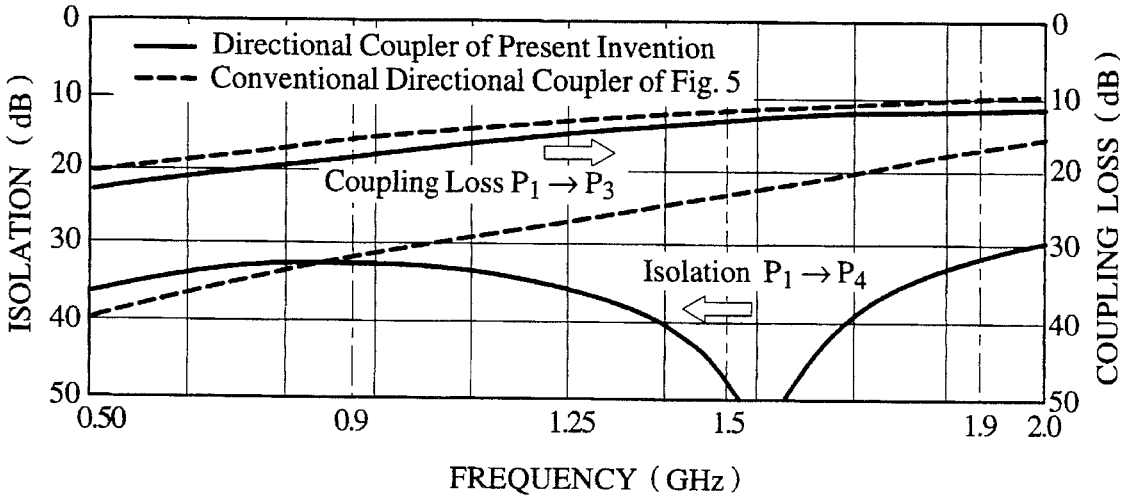
FIG. 3B is a graph showing the isolation and coupling loss of the strip line-type high-frequency element of the present invention and a conventional strip line-type high-frequency element.

The characteristics (insertion loss, isolation and coupling loss) of the directional coupler in this embodiment were measured in a wide range of a frequency from 0.5 GHz to 2 GHz. The results are shown by solid lines in FIGS. 3A and 3B. As is apparent from their comparison with those of the conventional directional coupler which are shown by the dotted lines, the directional coupler of the present invention is extremely superior to the conventional one in insertion loss and isolation. For instance, when the directional coupler of the present invention is compared with the conventional directional coupler at 1.5 GHz, differences between them are 0.3 dB vs. 0.5 dB in insertion loss and 48 dB vs. 23 dB in isolation. Particularly, the difference in insertion loss becomes as large as 0.4 dB vs. 1.0 dB at a higher frequency of 1.9 GHz. Incidentally, there is a difference of about 2 dB in a coupling loss, but such a difference of coupling loss is merely derived from a difference in design, having nothing to do with the performance of a directional coupler.

Figure 4:
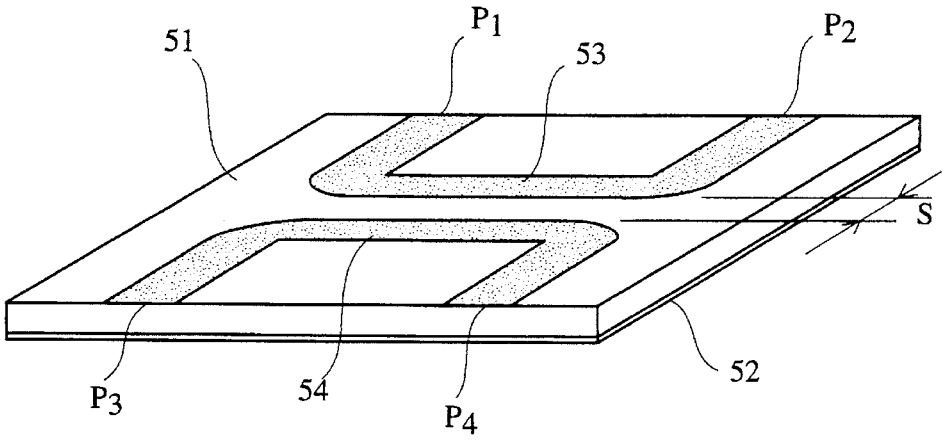
FIG. 4 Prior Art
FIG. 4 is a perspective view showing a conventional strip line-type high-frequency element.
Figure 5:
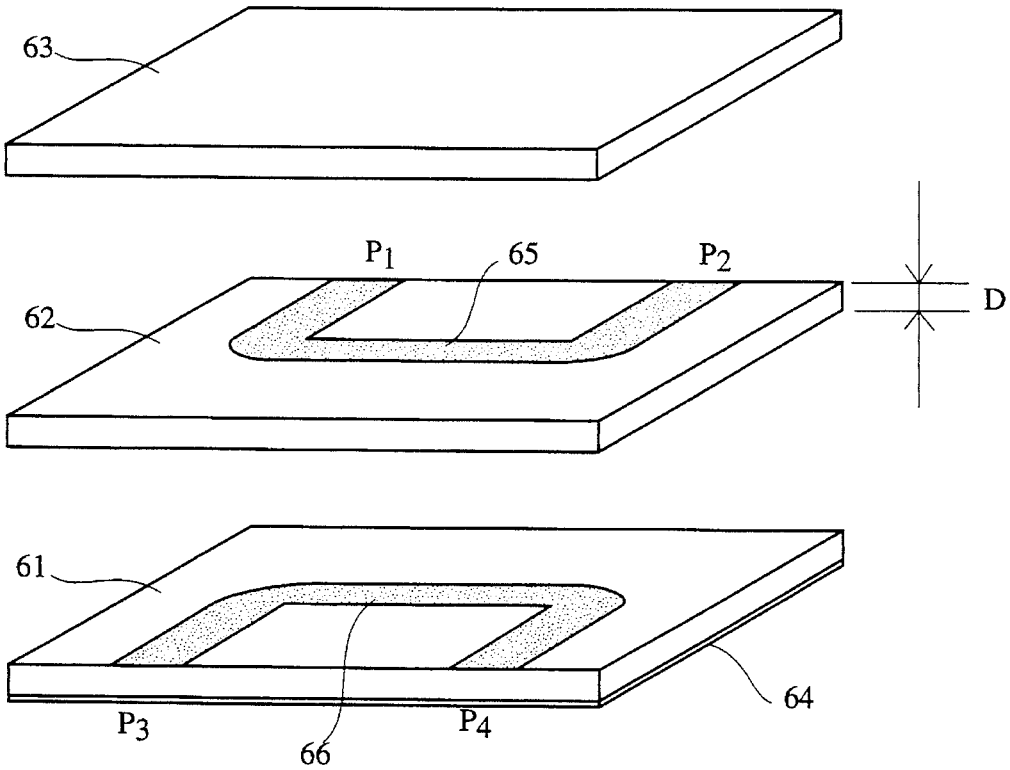
FIG. 5 Prior Art
FIG. 5 is an exploded perspective view showing a conventional strip line-type high-frequency element.
Figure 6:
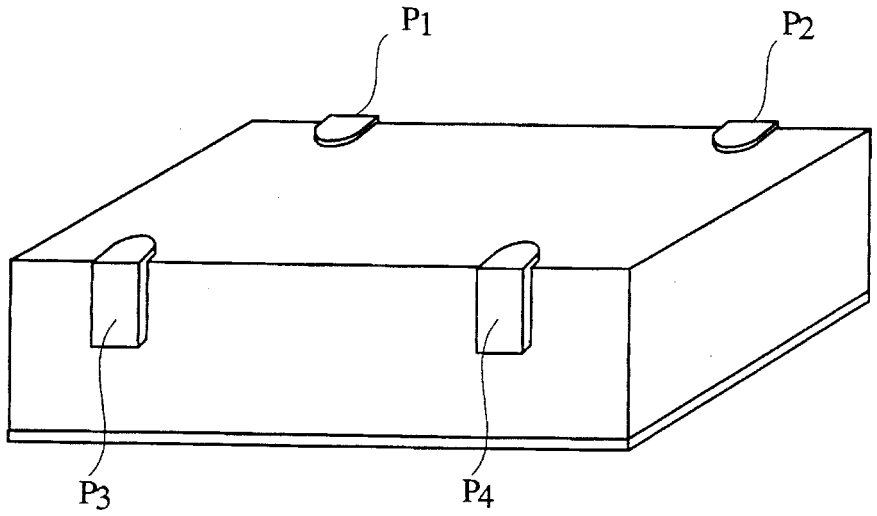
FIG. 6 Prior Art
FIG. 6 is a perspective view showing another conventional strip line-type high-frequency element.
Figure 7:
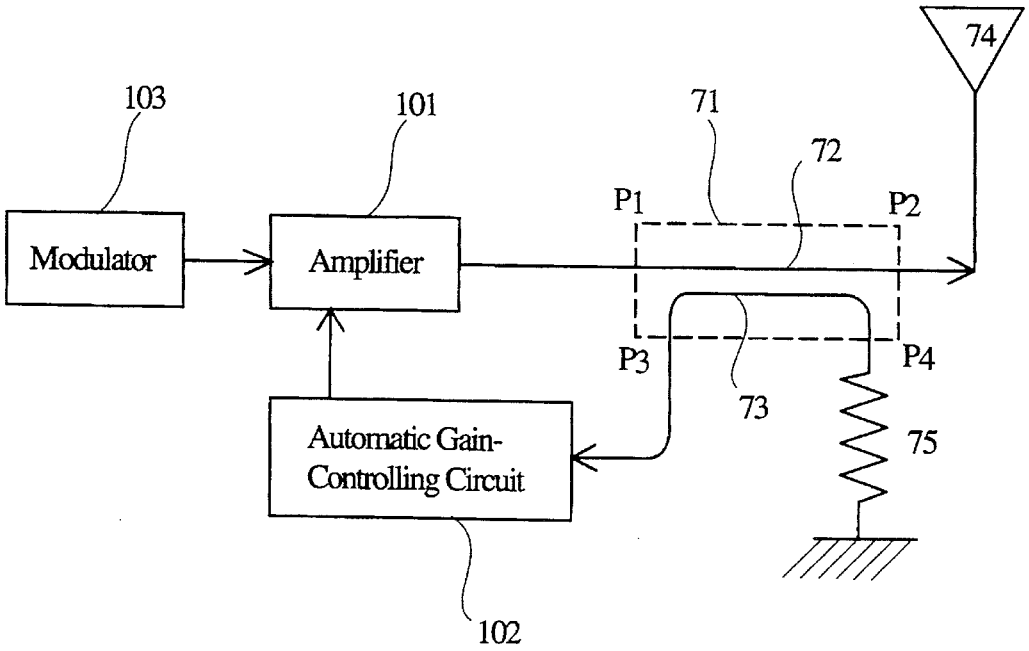
FIG. 7 Prior Art
FIG. 7 is a block diagram showing a circuit comprising a directional coupler.

The feature of the present invention is not U-shaped strip lines based on the basic idea of a conventional distributed constant line circuit as shown in FIGS. 4 and 5, but strip lines in the shape of a coil having one or more turns as in a lumped element circuit shown in FIG. 1. By connecting a plurality of such coil-forming strip lines (two in this embodiment), which are essentially distributed element lines, to each other to form a coil, high performance can be achieved in a wide frequency range. Accordingly, it is important that the strip lines look aligned in a direction perpendicular to their winding direction. In this embodiment, the strip line electrodes 3*a* 4*a*, 5*a*, 6*a* are substantially aligned on the same line except for lead portions to be connected to the external electrodes. That is, when viewed from above in a direction perpendicular to the winding direction, all the strip lines look aligned. Though it is most desirable in the present invention that the strip lines look aligned when viewed from above in a direction perpendicular to the winding direction, some parts of the strip lines need not be aligned as long as the performance of the directional coupler of the present invention is not seriously affected.

In the embodiment of the present invention, the strip line has a flat cross section whose longer side is in parallel to the ground conductor. With this shape, a mounting density in a vertical direction is high, and the main lines are strongly coupled with the sub-lines.

Incidentally, one strip line used in the present invention has both ends connected to the electrodes at two ports. In the basic structure of the present invention, a plurality of strip lines are disposed in an area covered by a plurality of ground conductors. In this embodiment, two strip lines are separately connected to the external electrodes, but a plurality of strip lines may be connected to one external electrode in some cases without changing the effects of the present invention.

Though a non-magnetic, dielectric substrate is used in the embodiment of the present invention, it would easily be understood by those skilled in the art that a magnetic substrate can also be used to achieve the same effects of the present invention. An important point of the present invention is that a plurality of strip lines are connected to form a coil within an area covered by the ground conductors, and that the effects of such a structure are enhanced by using a magnetic substrate. In fact, by preparing a substrate with Ni-Zn-Cu ferrite having a relative permeability μ of about 20 to form a matching transformer operable at 200 MHz, good results were obtained with little impedance change in a wide frequency range.

Also, in the above embodiment, the entire length of the main line consisting of strip line electrodes 3*a*, 4*a* and the entire length of the sub-line consisting of strip line electrodes 5*a*, 6*a* were set to correspond to 1/12 of a wave length. On the other hand, the length of a strip line is 1/4 of a wave length in the conventional directional coupler. Thus, the embodiment of the present invention provides a drastically miniaturized directional coupler in which the length of a strip line is reduced to as small as 1/12 of a wave length. Also, it has been found that the entire length of each strip line electrode can be reduced to a range of 1/8 to 1/15 of a wave length in the directional coupler of the present invention, because the directional coupler of the present invention has strip lines forming a coil of one or more turns as in the above-mentioned lumped constant circuit element.

Figure 8:
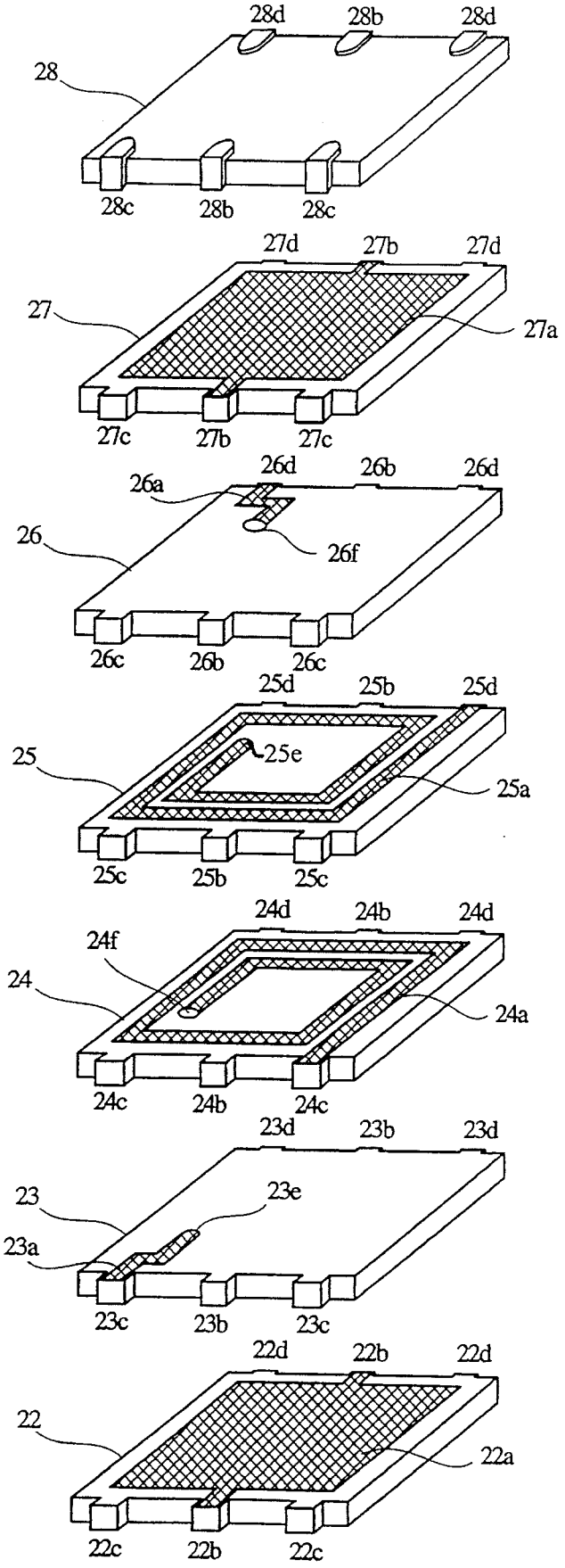
FIG. 8 is an exploded perspective view showing a strip line-type high-frequency element according to another embodiment of the present invention.

A chip-type directional coupler according to another embodiment of the present invention is shown in FIG. 8. This chip-type directional coupler is constituted by a laminate of a first ground conductor electrode substrate 22, main strip line electrode substrates 23, 24, sub-strip line electrode substrates 25, 26, a second ground conductor electrode substrate 27, and a protective substrate 28. Each substrate is made from a ceramic green sheet.

The first ground conductor electrode substrate 22 is formed by coating a ceramic green sheet with a ground conductor electrode 22*a* with small edge portions of the green sheet uncovered. The ground conductor electrode 22*a* is provided with two projections at center points in side edges, and the two projections are connected to two external electrodes 22*b*. The substrate 22 is provided with separate external electrodes 22*c*, 22*d* at side edges, which are connected to the main line and the sub-line.

The substrate 23 for the main line is prepared by forming a strip line electrode 23*a* and a through-hole round electrode 23*e* on one surface of a ceramic green sheet. One end of the strip line electrode 23*a* is connected to an external electrode 23*c*. The substrate 23 is provided with external electrodes 23*b*, 23*c*, 23*d* at side edges.

Another main strip line substrate is denoted by a reference numeral 24 in FIG. 8. This substrate 24 is prepared by forming a strip line electrode 24*a* and a through-hole 24*f* on one surface of a ceramic green sheet. One end of the strip line electrode 24*a* is connected to an external electrode 24*c*, and the other end of the strip line electrode 24*a*, which is a through-hole 24*f*, is connected to a through-hole round electrode 23*e* on the strip line substrate 23. The connected strip line electrodes 23*a*, 24*a* form a two-turn coil. The substrate 24 is provided with external electrodes 24*b*, 24*c* and 24*d* at side edges thereof.

The substrates 25, 26 for the sub-line have the same structures as those of the substrates 23, 24 for the main line. The strip line electrodes 25*a* and 26*a* are connected to each other via a through-hole 26*f* and a round electrode 25*e*, respectively, to form a two-turn coil. The ends of the strip line electrodes 25*a*, 26*a* are respectively connected to external electrodes 25*d*, 26*d* at side edges. The substrates 25, 26 are provided with separate external electrodes 25*b*, 25*c*, 25*d*, 26*b*, 26*c* and 26*d* at side edges.

The second ground conductor electrode substrate 27 has the same structure as that of the first ground conductor electrode substrate 22, and may be prepared by forming a ground conductor electrode 27*a* on one surface of a ceramic green sheet with its edge portions uncovered. Substrate 27 is also provided with separate external electrodes 27*c*, 27*d* at side edges thereof.

The first ground conductor electrode 22*a* is connected to the second ground conductor electrode 27*a* via external electrodes 22*b*, 23*b*, 24*b*, 25*b*, 26*b* and 27*b*, covering the strip line electrodes 23*a*, 24*a*, 25*a* and 26*a*. With this structure, a shield effect of preventing high frequency from leaking outside can be obtained.

The protective substrate 28 is provided with separate external electrodes 28*b*, 28*c*, 28*d* at an upper surface and side edges.

The green sheets 22–28 are printed with electrode layers, laminated, and then sintered at a temperature of 900° C. or higher to form a chip-type directional coupler 1 as shown in FIG. 2.

In this embodiment, a spiral or helical coil of two turns is formed on a green sheet, and two green sheets with such helical coils may be laminated to lead out the ends of the coil. The directional coupler of this second embodiment similarly provides good characteristics as in the first embodiment. Thus, the effect of the present invention is achieved by forming spiral or helical strip line electrodes. In this case, too, when viewed from above in a direction perpendicular to the winding direction in FIG. 8, all the strip lines look aligned.

The present invention provides an extremely miniaturized chip-type directional coupler showing excellent high-frequency characteristics in a wide frequency range. Though the directional couplers have been explained in the embodiments, the more generalized idea of the present invention is that a plurality of strip lines are connected to form a coil or helical shape within an area covered by the ground conductors, and that the coil or helical portions of the strip lines are aligned to each other. It is evidently applicable to other strip line-type high-frequency elements such as distributors, matching transformers, etc.

As described in detail above, the present invention provides an extremely miniaturized strip line-type high-frequency element such as a chip-type directional coupler and similar high-frequency elements, which are useful to miniaturize microwave devices in portable telephones, etc.

What is claimed is:

1. A strip line-type high-frequency element comprising:

a plurality of vertically spaced, parallel wide ground conductors, including a first wide ground conductor and a second wide ground conductor, each ground conductor having a respective central portion aligned so as to define a central axis, and a main line and a subline, vertically spaced and in vertical alignment, said main line and said subline each respectively comprising a first strip line and a corresponding second strip line;

each of said first and said corresponding second strip line (1) comprising, in sequence, a first end, a lead portion, an open coil portion, and a second end, and (2) being disposed between said first wide ground conductor and said second wide ground conductor;

for each of said main line and said subline, said first end of said respective first strip line being vertically spaced from said first end of said corresponding second strip line, and said second end of said respective first strip line being coupled to said second end of said corresponding second strip line to define a respective continuous strip line, said open coil portion of said respective first strip line and said open coil portion of said corresponding second strip line being positioned about said central axis, vertically spaced, and in vertical alignment, said respective continuous strip line thereby defining a vertically extending coil of one or more turns.

2. The strip line-type high-frequency element according to claim 1, wherein said respective first strip line and said corresponding second strip line of each of said main line and said subline are constituted by corresponding conductors disposed on two or more dielectric substrates.

3. The strip line-type high-frequency element according to claim 1, wherein said respective first strip line and said corresponding second strip line of each of said main line and said subline are constituted by corresponding conductors disposed on two or more magnetic substrates.

4. The strip line-type high-frequency element according to claim 1, wherein each of said first and second strip lines has a respective length which is between 1/8 to 1/15 of a wave length of an input signal applied thereto, whereby said strip line-type high-frequency element is configured to function as a directional coupler.

5. A strip line-type high-frequency element constituted by a laminate comprising a plurality of substrates which comprises, in sequence:

a substrate with a first ground conductor electrode disposed thereon and having lead portions extending to side edges thereof;

a substrate with a first strip line electrode of less than one turn disposed thereon and having a lead portion extending to a first side edge of said substrate at one end thereof and a through-hole round electrode at the other end thereof;

a substrate with a second strip line electrode of less than one turn disposed thereon and having a lead portion extending to said first side edge of said substrate at one end thereof and a through-hole electrode at the other end thereof;

a substrate with a third strip line electrode of less than one turn disposed thereon and having a lead portion extending to a second side edge of said substrate at one end thereof and a through-hole round electrode at the other end thereof;

a substrate with a fourth strip line electrode of less than one turn disposed thereon and having a lead portion extending to said second side edge of said substrate at one end thereof and a through-hole electrode at the other end thereof;

a substrate with a second ground conductor electrode disposed thereon and having lead portions extending to side edges thereof; and a protective substrate, wherein the through-hole round electrode of said first strip line electrode is connected to the through-hole electrode of said second strip line so as to define a first line, and the through-hole round electrode of said third strip line electrode is connected to the through-hole electrode of said fourth strip line so as to define a second line, one of said first and second lines being a main line while the other one of said first and second lines being a subline, whereby said strip line-type high-frequency element is configured to function as a directional coupler.

6. A strip line-type high-frequency element constituted by a laminate comprising a plurality of substrates which comprises, in sequence:

a substrate with a first ground conductor electrode disposed thereon and having lead portions extending to side edges thereof;

a substrate with a first strip line electrode of less than one turn disposed thereon and having a lead portion extending to a first side edge of said substrate at one end thereof and a through-hole round electrode at the other end thereof;

a substrate with a second strip line electrode of one or more turns disposed thereon and having a lead portion extending to said first side edge of said substrate at one end thereof and a through-hole electrode at the other end thereof;

a substrate with a third strip line electrode of one or more turns disposed thereon and having a lead portion extending to a second side edge of said substrate at one end thereof and a through-hole round electrode at the other end thereof;

a substrate with a fourth strip line electrode of less than one turn disposed thereon and having a lead portion extending to said second side edge of said substrate at one end thereof and a through-hole electrode at the other end thereof;

a substrate with a second ground conductor electrode disposed thereon and having lead portions extending to side edges; and a protective substrate, wherein the through-hole round electrode of said first strip line electrode is connected to the through-hole electrode of said second strip line so as to define a first line, and a through-hole round electrode of said third strip line electrode is connected to the through-hole electrode of said fourth strip line so as to define a second line, one of said first and second lines being a main line while the other one of said first and second lines being a subline, whereby said strip line-type high-frequency element is configured to function as a directional coupler.

* * * * *